US005868477A

United States Patent [19]

Decarie

[11] Patent Number: 5,868,477

[45] Date of Patent: Feb. 9, 1999

[54] FIRE ALARM LEVER ENCLOSURE

[76] Inventor: Paul Decarie, 155 Norfinch Drive, Unit #5, Toronto, Ontario, Canada, M3N 1Y2

[21] Appl. No.: 19,816

[22] Filed: Feb. 6, 1998

[51] Int. Cl.[6] ..... A47F 5/08

[52] U.S. Cl. ..... 312/245; 312/114; 312/265.6; 169/51; 206/803

[58] Field of Search ..... 312/114, 245, 312/265.6; 52/98; 428/43, 409; 206/803; 220/265, 266, 277, 327, 476, 480, 662; 169/51; 239/282

[56] References Cited

U.S. PATENT DOCUMENTS

| | | | |
|---|---|---|---|
| 618,887 | 2/1899 | Levit | 312/114 |
| 2,083,324 | 6/1937 | Edwards . | |
| 3,715,743 | 2/1973 | Denton . | |
| 3,722,733 | 3/1973 | Neumann | 220/662 X |
| 4,017,133 | 4/1977 | Sigler | 312/204 X |
| 4,726,365 | 2/1988 | Jablonski | 206/803 X |
| 5,638,906 | 6/1997 | McCabe | 169/51 |

FOREIGN PATENT DOCUMENTS

| | | |
|---|---|---|
| 238672 | 3/1924 | Canada . |
| 1292299 | 11/1991 | Canada . |

*Primary Examiner*—Peter M. Cuomo
*Assistant Examiner*—Karlena D. Schwing
*Attorney, Agent, or Firm*—Arne I. Fors

[57] ABSTRACT

A fire alarm station pull cover with a rectangular box shape enclosure that is open in the front, back and bottom and has a removable cap. The cover is mounted to a wall fully encasing a fire alarm pull lever. A glass pane resides in grooves on both sides of the apparatus and is supported laterally by said grooves and vertically by a detent at the bottom of each groove. One or a plurality of equi-spaced vertical score marks formed on the pane of glass causes the pane to controllably break into parts when struck by a striker preferably attached by a tether to the cover. The sections of glass fall down and out through the open bottom to expose said pull lever and allow actuation of the lever.

9 Claims, 3 Drawing Sheets

10
11
12
14
16
18
20
22
24
26
28
30
31
32
34
36
38
40
42
43
44
45
46
46a
46b
46c
47
50
52
60
62

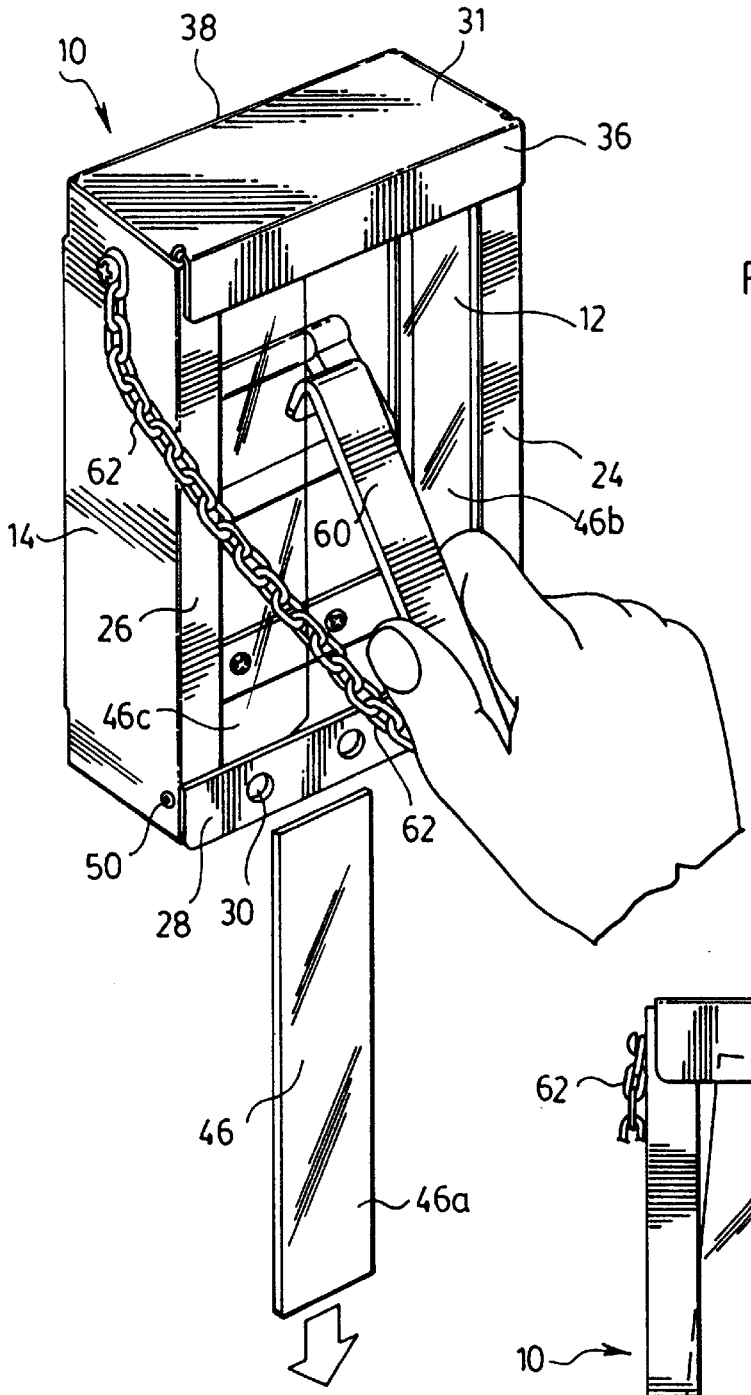
FIG. 4.
FIG. 5.
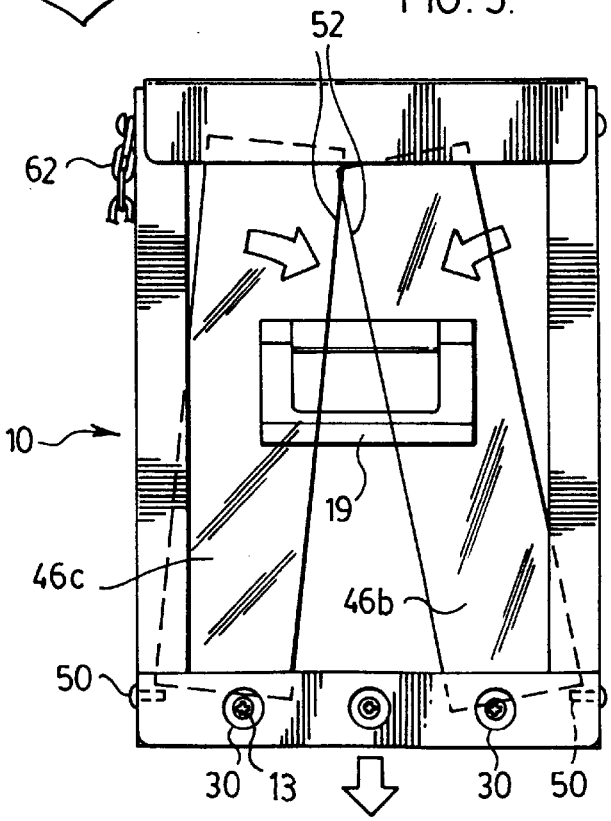

FIRE ALARM LEVER ENCLOSURE

BACKGROUND OF THE INVENTION (i) Field of the Invention

The present invention relates to a fire alarm pull station. In particular, the present invention relates to a fire alarm pull station enclosure which comprises a rectangular metal box having an open front in which a breakable pane of glass is supported.

(ii) Description of the Related Art

It is well known in the art of fire alarm safety devices to use breakable glass fronts in order to gain access to either fire extinguishers, fire hoses or fire alarm pull levers. Generally, there are two types of fire alarm pull stations on which all variations are based. The first "free lever" pull type employs a small glass rod of minimal diameter or a small pane of glass which is shattered upon pull lever activation. The pull lever is not enclosed by a pull station "box". Edwards U.S. Pat. No. 2,083,324 issued Jun. 8, 1937 discloses such a fire alarm pull station in which an exposed pull lever contains a small pane of glass which is shattered upon activation of the pull lever in a downward fashion. The pane of glass only protects actuation of circuitry and does not prevent tampering with the lever.

The second "box enclosure" type has a pull lever enclosed within a rectangular or square box with a breakable glass front. The disadvantages of the free lever type of pull station, namely possible tampering with the pull lever due to unimpeded access, have been substantially overcome by the use of the enclosed pull station. Once the glass front is shattered one gains access to the pull lever. However, there have also been significant disadvantages to the box type pull stations. The first is the impeded access to the lever itself. While this structure was introduced to alleviate concerns with the free lever type pull station, the encasement of the lever, while eliminating some problems, has also created others. One must break the outer pane of glass to actuate the lever located inside the box. At times several blows to the glass pane are required to remove the outer glass and gain access to the lever. This results in lost time which is vitally important to the operator. The second disadvantage to the box type pull station is the safety issue regarding glass fragments remaining attached to the outer metal box. The conventional embodiment of the box type pull station has grooves which surround the pane and provide the pane of glass with stability. Once the pane is shattered, several glass fragments can remain within these grooves and provide a significant safety risk to the user when the user attempts to activate the pull lever. This risk is magnified in that the operator of the device, having discovered a fire, will invariably be under stress and will try to operate the device as quickly as possible. It is a principal object of the present invention to improve upon the latter "box enclosure" fire alarm pull station.

SUMMARY OF THE INVENTION

The disadvantages of the prior art may be overcome by providing an improved box type apparatus to allow quick access to the pull lever, in which the user can actuate the pull lever without the danger of glass fragments remaining attached to the outer metal box, while maintaining the important advantage of a tamper deterrent associated with the box type pull station.

The present invention embodies a metal box, preferably a sheet steel alloy, in a rectangular shape with a large opening on the front of the box to allow for a pane of glass. The box is open at the bottom end allowing for the glass to fall through when the device is employed and the glass is broken. The box is secured to the wall wherein a pull lever is attached in such a way that the box fully encloses said pull lever. The top and sides of the box are closed. Attached to the outside of one of the sides of the box with a screw is a chain. At the extreme end of the chain is a striking device which can be used to break the glass and gain access to the pull lever.

According to one aspect of the present invention the glass is weakened by a vertical score mark or a pair or more of equi-spaced vertical score marks formed on the glass pane. These cause the glass pane to break controllably into two, three or more parts along the score marks when struck by the striker.

According to another aspect of the present invention there is provided two detents which support the glass pane at its two lower corners. The detents act, along with grooves along the sides of the glass pane, as support. Upon striking and fracturing of the glass pane, along the score mark or score marks, the glass pane collapses and glass portions are released from the detents to fall through the open bottom of the box. In the embodiment of glass pane having a pair of equispaced score marks, the middle portion of the glass pane falls through the bottom of the box and the two remaining side portions of glass fall toward the centre of the box essentially collapsing upon themselves and continue their fall through the open bottom of the box.

In its broad aspect, the fire alarm pull station enclosure of the invention for a pull lever comprises a metal box of rectangular shape having a pair of spaced-apart parallel side walls defining an open front and back and an open bottom, a removable cap mounted on said side walls, means for removably attaching the box to a supporting wall; a rectangular transparent glass pane having opposite side edges and bottom corners, and having at least one vertical score mark formed thereon; each of said side walls having an inwardly facing vertical groove adjacent the open front for loosely receiving said side edges of the pane of glass for lateral support; and detent means formed at the bottom of each groove for engaging the bottom corners of the glass pane for vertical support. In its preferred embodiment, the enclosure preferably includes a pair of equispaced vertical score mark formed on the pane of glass, whereby the glass pane will controllably break into three parts, and a striker and an elongated tether for attaching the striker to the enclosure, whereby an operator can break the glass pane along a vertical score mark for discharge of broken glass down and out through the open bottom for access to the pull lever.

BRIEF DESCRIPTION OF THE DRAWINGS

Drawings which illustrate embodiments of the present invention will now be described, by way of example only, with reference to the attached Figures, wherein:

FIG. 4 is a perspective view of the assembled fire alarm pull station in use showing the first stage of controlled glass breakage; and FIG. 5 is a front elevation of the fire alarm station shown in FIG. 4 illustrating the second stage of glass pane breakage.

DETAILED DESCRIPTION OF THE INVENTION

Figure 1:
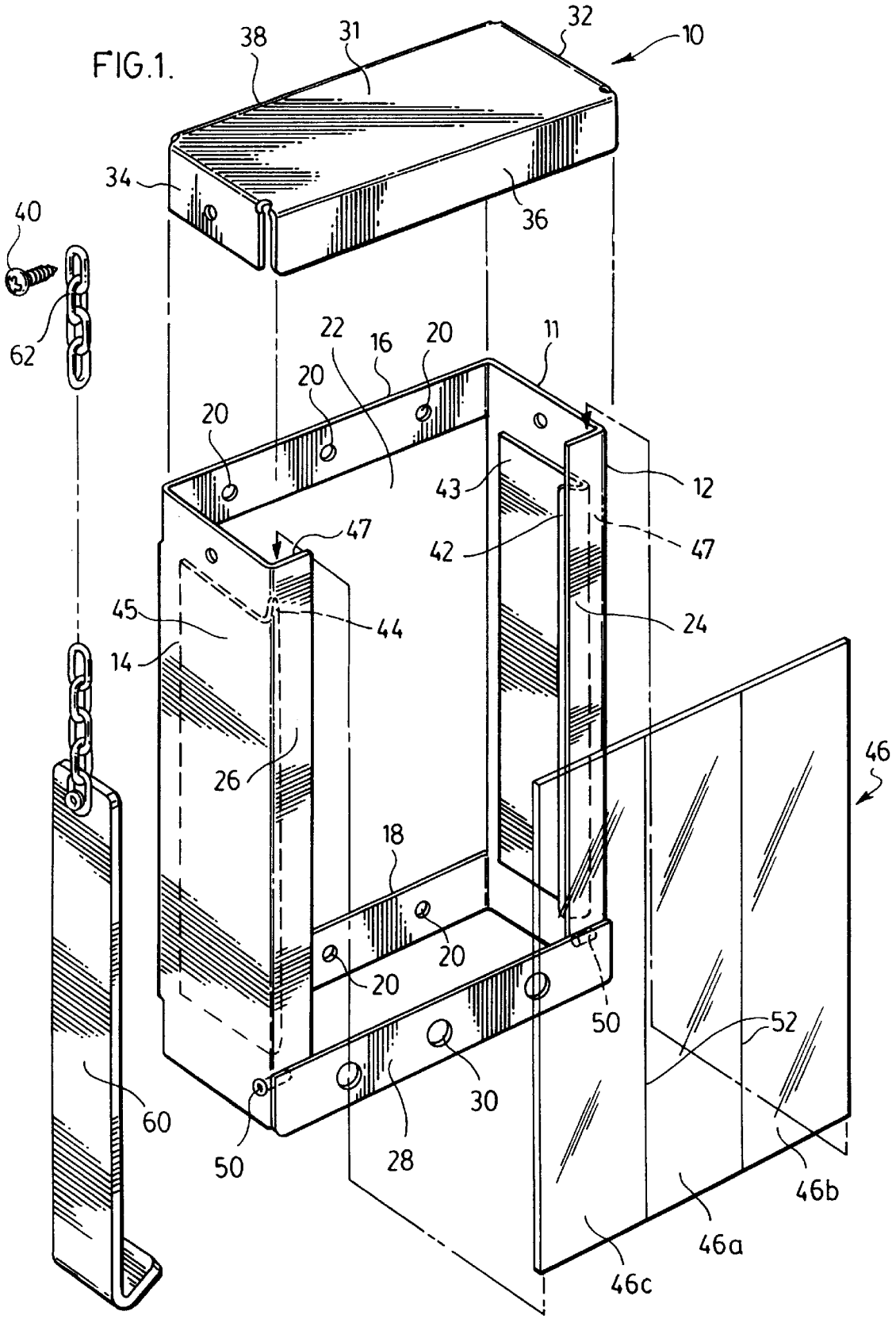
FIG. 1 is an exploded perspective view of an embodiment of a fire alarm pull station cover of the present invention.
Figure 3:
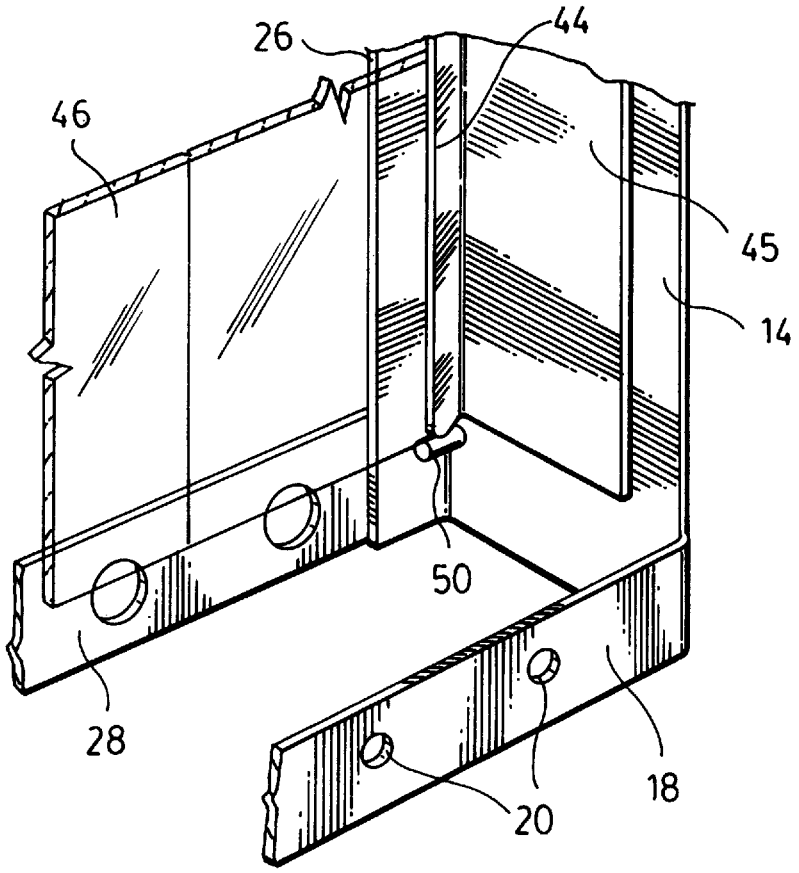
FIG. 3 is an enlarged fragmentary perspective view illustrating in detail the groove and detent support for the glass pane.
Figure 2:
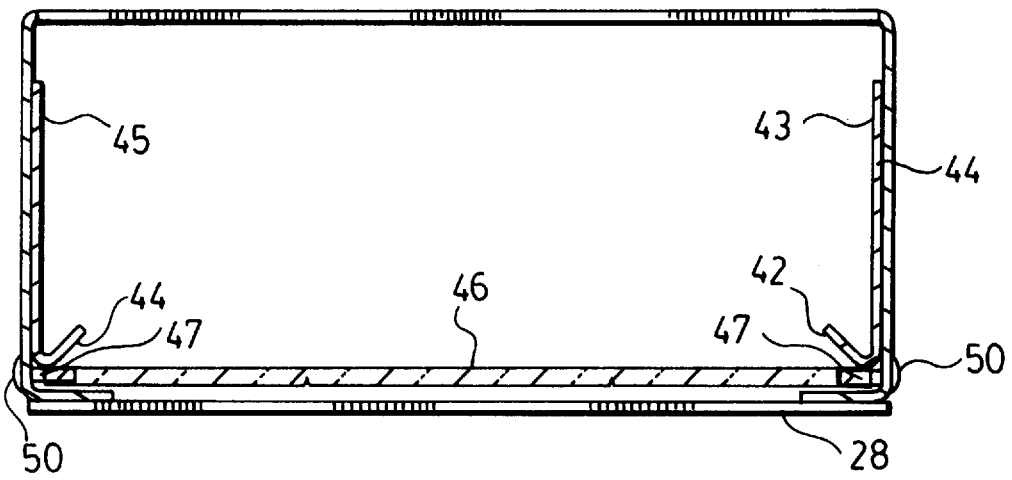
FIG. 2 is a horizontal section facing downwardly showing the groove and detent support of the pull station cover of FIG. 1.

FIGS. 1–5 illustrate an embodiment of the pull station cover of the invention which comprises the open-back box enclosure cover 10 which is screwed to a wall so as to encase within the box the fire alarm pull lever 19 (FIG. 5). The enclosure 10 is of rectangular shape and comprises a frame 11 consisting of a pair of spaced-apart parallel side walls 12, 14 joined at the rear edges thereof at the top and bottom by connecting strips 16, 18 respectively formed integral therewith. Screw holes 20 formed in strips 16, 18 permit securement of the enclosure 10 to a support wall by screws 13 (FIG. 5). Opening 22 defined between side walls 12, 14 and strips 16, 18 is sufficiently large to receive pull lever 19. The front edges of side walls 12, 14 have inwardly facing flanges 24, 26 for reasons which will become apparent as the description proceeds. A front bottom plate 28 secured to flanges 24, 26 such as by spot welding has holes 30 formed therein in alignment with holes 20 in rear bottom strip 18 to allow insertion of a screw driver for driving screws through holes 20.

A cap 31 having end flanges 32, 34 and front and rear flanges 36, 38 is secured to side walls 12, 14 at the top thereof by screws 40 passing through end flanges 32, 34. Each of side walls 12, 14 has an upstanding inner rib 42, 44 bent rearwardly at an angle of about 45° to the plane of front flanges 24, 26 from elongated plates 43, 45 attached thereto such as by spot welding along their length at a uniform distance from front flanges 24, 26 respectively to receive the side edges of glass pane 46 in slots 47 defined between the front flanges and ribs. A detent 50, such as a rivet passing through side walls 12, 14, closes the bottom of slots 47. Flanges 42–44 can be crimped at their bases to form a detent, not shown, to close the bottoms of slots 47.

In assembly, mounting screws 13 are driven through upper and lower screw holes 20 to secure frame 11 to a supporting wall. Glass pane 46 is inserted from above in the slots 47 defined between front flanges 24, 26 and ribs 42, 44 and is supported at its lower corners by shallow detent 50 projecting from side walls 12, 14 into the said slots. Closure cap 31 is then attached to side walls 12, 14 by screws 40, whereby the cap front flange 36, side wall flanges 24, 26, and bottom plate 28 conceal the edges of glass pane 46.

Glass pane 46 has one or a plurality of score marks 52 formed vertically on the inner side of the pane substantially along the length thereof. In the preferred embodiment typified in the figures, a pair of equispaced score marks 52 are formed.

A striker 60 attached to a side wall by a tether such as chain 62 can be conveniently used by an operator to strike the glass pane which is rendered frangible by the score marks 52 to break along the score marks into three portions. The centre portion 46*a* of said broken pane of glass 46 falls through the open bottom of the box 10. The outer portions 46*b* and 46*c* of said pane of glass 46, now lacking lateral support, fall first towards the rear and then inwardly across the now vacated centre portion and continue down and out through the open bottom end of the box 10, rendering the pull lever 19 accessible.

The present invention provides a number of advantages. The fire alarm pull station cover maintains the desired result of protecting the pull lever from easy access tampering or accidental actuation. The apparatus of the invention, with the use of one or a plurality of equispaced vertical score marks, controls the breakage of the pane of glass so that in the preferred embodiment with a pair of score marks the centre piece falls through the bottom of the apparatus and the outer pieces fall upon themselves and continue down and out through the bottom of the apparatus. This "controlled breakage" precludes the need for additional blows of the striker and therefore results in quicker access to the pull lever. The use of the detents as a support system at the bottom of the apparatus allows for the elimination of a groove along the bottom of the apparatus; this, combined with the use of the vertical score marks to initiate a controlled breakage, allows for the pieces of glass to completely fall away from the grooves on either side of the apparatus and through the bottom of the box; all of which precludes glass shard fragments remaining in the grooves or around the apparatus itself and therefore minimizes risk to the operator.

It will be understood that modifications can be made in the embodiment of the invention illustrated and described herein without departing from the scope and purview of the invention as defined by the appended claims.

I claim:

1. A fire alarm pull station enclosure for a pull lever comprising:

a metal box of rectangular shape having a pair of spaced-apart parallel side walls defining an open front and back and an open bottom, a removable cap mounted on said side walls, means for removably attaching the box to a supporting wall; a rectangular glass pane having opposite side edges and bottom corners, and having at least one vertical score mark formed thereon;

each of said side walls having an inwardly facing vertical groove adjacent the open front for loosely receiving said side edges of the pane of glass for lateral support; and detent means formed at the bottom of each groove for engaging the bottom corners of the glass pane for vertical support.

2. A fire alarm pull station enclosure as claimed in claim 1, additionally comprising a striker and an elongated tether for attaching the striker to the enclosure, whereby an operator can break the glass pane along a vertical score mark for discharge of broken glass down and out through the open bottom for access to the pull lever.

3. A fire alarm pull station enclosure as claimed in claim 2 in which the glass pane has a pair of equispaced vertical score mark formed thereon whereby the glass pane will controllably break into three parts.

4. A fire alarm pull station enclosure as claimed in claim 3 in which each of said side walls has an inwardly facing front flange defining sides of the open front, and an inwardly facing rib formed on each of said side walls defining with said front flange a vertical groove.

5. A fire alarm pull station enclosure as claimed in claim 4 in which each said detent means comprises an inwardly projecting stud attached to the side wall and extending into the groove to engage a bottom corner of the glass pane.

6. A fire alarm pull station enclosure as claimed in claim 5 in which the inwardly facing rib is a flange formed on an elongated metal strip attached to the side wall.

7. A firm alarm pull station enclosure as claimed in claim 6 in which the said flange is bent rearwardly to define an angle of about 45° to the side wall.

8. A fire alarm pull station enclosure as claimed in claim 1 in which said removable cap is secured to the side walls by screws.

9. A fire alarm pull station enclosure as claimed in claim 3 in which said means for removably attaching the box to a supporting wall comprises upper and lower metal strips formed integral with the side walls adjacent the back of the side walls and defining with the side walls the open back, said metal strips having a plurality of apertures therein for receiving screws.

* * * * *